US005552861A

United States Patent [19]

Mizude et al.

[11] Patent Number: 5,552,861

[45] Date of Patent: Sep. 3, 1996

[54] IMAGE FORMING APPARATUS HAVING CONTROLLER ADJUSTING CURRENT TO MAIN CHARGER AND TRANSFER CHARGER

[75] Inventors: Kazuhiro Mizude; Hisahiro Kato; Hideki Ishida; Tomohiro Tsutano, all of Osaka, Japan

[73] Assignee: Mita Industrial Co., Ltd., Japan

[21] Appl. No.: 352,865

[22] Filed: Dec. 2, 1994

[30] Foreign Application Priority Data

Dec. 10, 1993 [JP] Japan ..... 5-310161

[51] Int. Cl.[6] ..... G03G 21/00

[52] U.S. Cl. ..... 355/208; 355/221; 355/274

[58] Field of Search ..... 355/208, 219, 355/221, 225, 271, 274

[56] References Cited

U.S. PATENT DOCUMENTS

| | | | |
|---|---|---|---|
| 4,077,709 | 3/1978 | Borostyan et al. | 355/274 |
| 4,234,249 | 11/1980 | Weikel, Jr. et al. | 355/222 |
| 4,239,373 | 12/1980 | Weikel, Jr. | 355/274 |
| 4,896,192 | 1/1990 | Kinoshita | 355/274 X |
| 5,049,935 | 9/1991 | Saito et al. | 355/219 |
| 5,321,477 | 6/1994 | Nagata et al. | 355/274 X |

FOREIGN PATENT DOCUMENTS

| | | |
|---|---|---|
| 60-026363 | 2/1985 | Japan . |
| 60-026374 | 2/1985 | Japan . |

*Primary Examiner*—Robert Beatty

*Attorney, Agent, or Firm*—Beveridge, DeGrandi, Weilacher & Young, L.L.P.

[57] ABSTRACT

An image forming apparatus is provided with a high voltage transformer provided with one common secondary winding for supplying a high voltage power to a main charger and to a transferring charger, a resistor for sensing a shield current of the transferring charger, an error detecting amplifier for controlling a primary side of the high voltage transformer so that the sensed shield current is constant; a constant voltage device connected to a grid of the main charger for constant-voltage controlling the main charger, and a resistor inserted in a current path to the transferring charger for setting a current supplied from the high voltage transformer to the main charger to be greater than a current supplied from the high voltage transformer to the transferring charger.

3 Claims, 3 Drawing Sheets

IMAGE FORMING APPARATUS HAVING CONTROLLER ADJUSTING CURRENT TO MAIN CHARGER AND TRANSFER CHARGER

BACKGROUND OF THE INVENTION

1. Field of the Invention

The present invention relates to an image forming apparatus, and more particularly, to an image forming apparatus such as an electrophotographic copying machine which performs image formation by using a charger and a photoreceptor drum.

2. Description of the Prior Art

An image forming apparatus of this type includes a main charger for charging the surface of a photoreceptor drum and a transferring charger for transferring a toner image formed on the drum surface onto a sheet of paper. FIG. 1 shows a prior art device for supplying a high voltage power to the two chargers from one high voltage transformer.

In this prior art, a shield current of the main charger 2 is detected through a resistor R1, the detection value is compared with a reference value by an error detecting amplifier 9, the primary side of a high voltage transformer 7 is controlled through an inverter driving circuit 8 based on the comparison result, and a current is supplied from a secondary side to the main charger 2 to control a current flowing through the shield so that it is constant. This prior art suggests that the shield current of the transferring charger 5 may be controlled to be constant instead of controlling the shield current of the main charger 2 to be constant.

In the above-described prior art, the shield current of the charger is controlled to be constant in consideration of the fact that the ratio between the currents flowing from each wire of the chargers to the shield and the photoreceptor drum is in a predetermined relationship. However, in this prior art, the shield current of only one of the chargers is detected so that the shield current is constant, and the control is not performed with respect to the other charger.

For example, when the main charger 2 becomes dirty, the current is controlled to be constant by supplying more current in accordance with the dirt. However, since the dirt of the main charger 2 and the dirt of the transferring charger 5 are different, the current in the transferring charger 5 is a constant current which is different from a desired current value. This causes mistransfer and misseparation when a sheet 6 is separated from the drum.

SUMMARY OF THE INVENTION

An object of the present invention is to provide an image forming apparatus where a main charger and a transferring charger are both capable of performing excellent charging, said image forming apparatus being of a type where a high voltage power is supplied from a high voltage transformer to both the main charger and the transferring charger.

An image forming apparatus of the present invention is provided with the following: a photoreceptor drum; a main charger for charging a surface of the photoreceptor drum, said main charger including a wire and a shield; a transferring charger for generating an electric field toward the photoreceptor drum so that a toner image formed on the surface of the photoreceptor drum is transferred onto a sheet of paper, said transferring charger including a wire and a shield; a high voltage transformer for supplying a high voltage power to the main charger and to the transferring charger, said high voltage transformer being provided with one common secondary winding; sensing means for sensing a shield current of the transferring charger; controlling means for controlling a primary side of the high voltage transformer based on an output of the sensing means so that the shield current is constant; and means connected to a grid of the main charger for constant-voltage controlling the grid.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
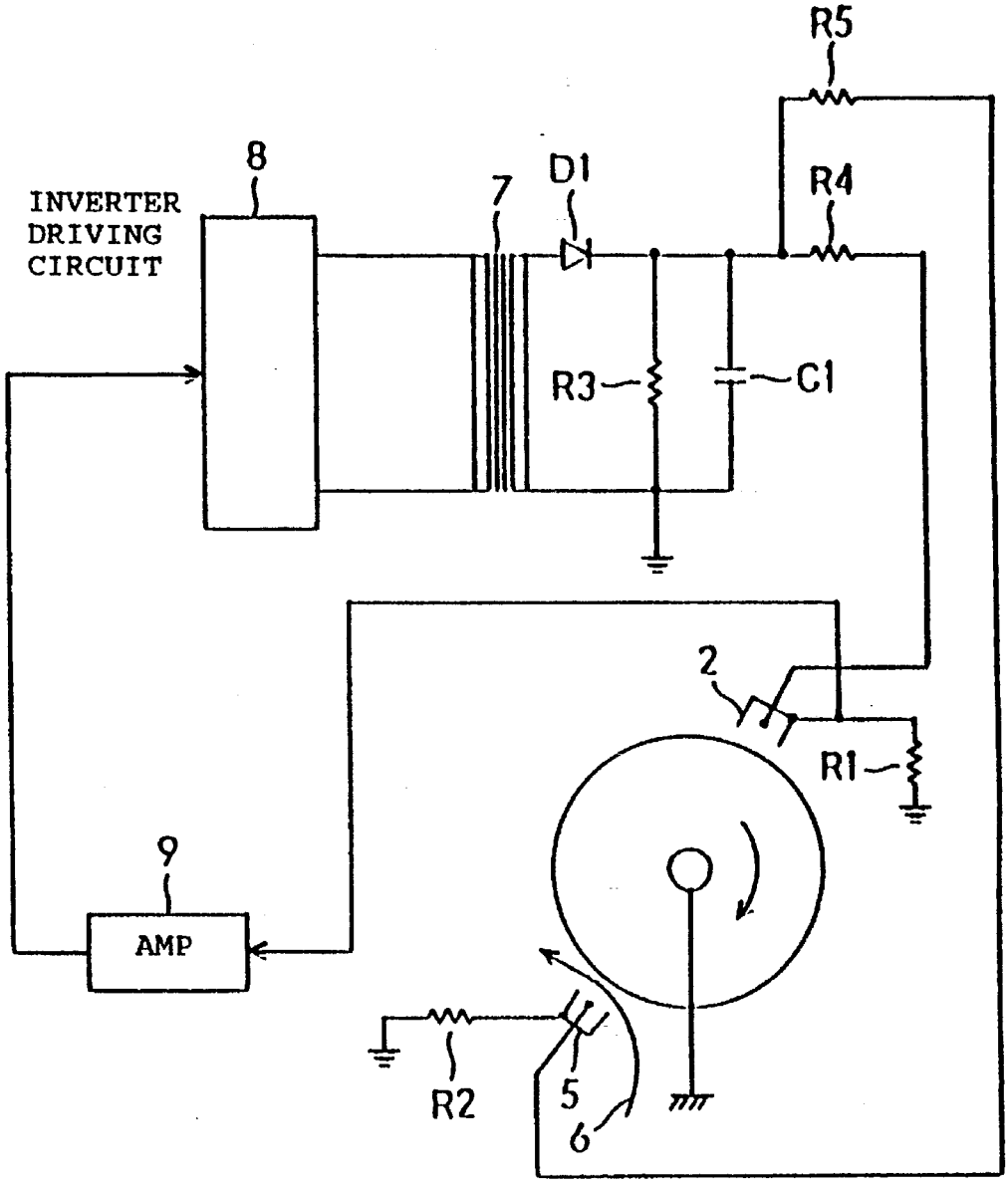
Fig. 1 Prior art
FIG. 1 is a circuit diagram of a relevant portion of a conventional image forming apparatus.
Figure 2:
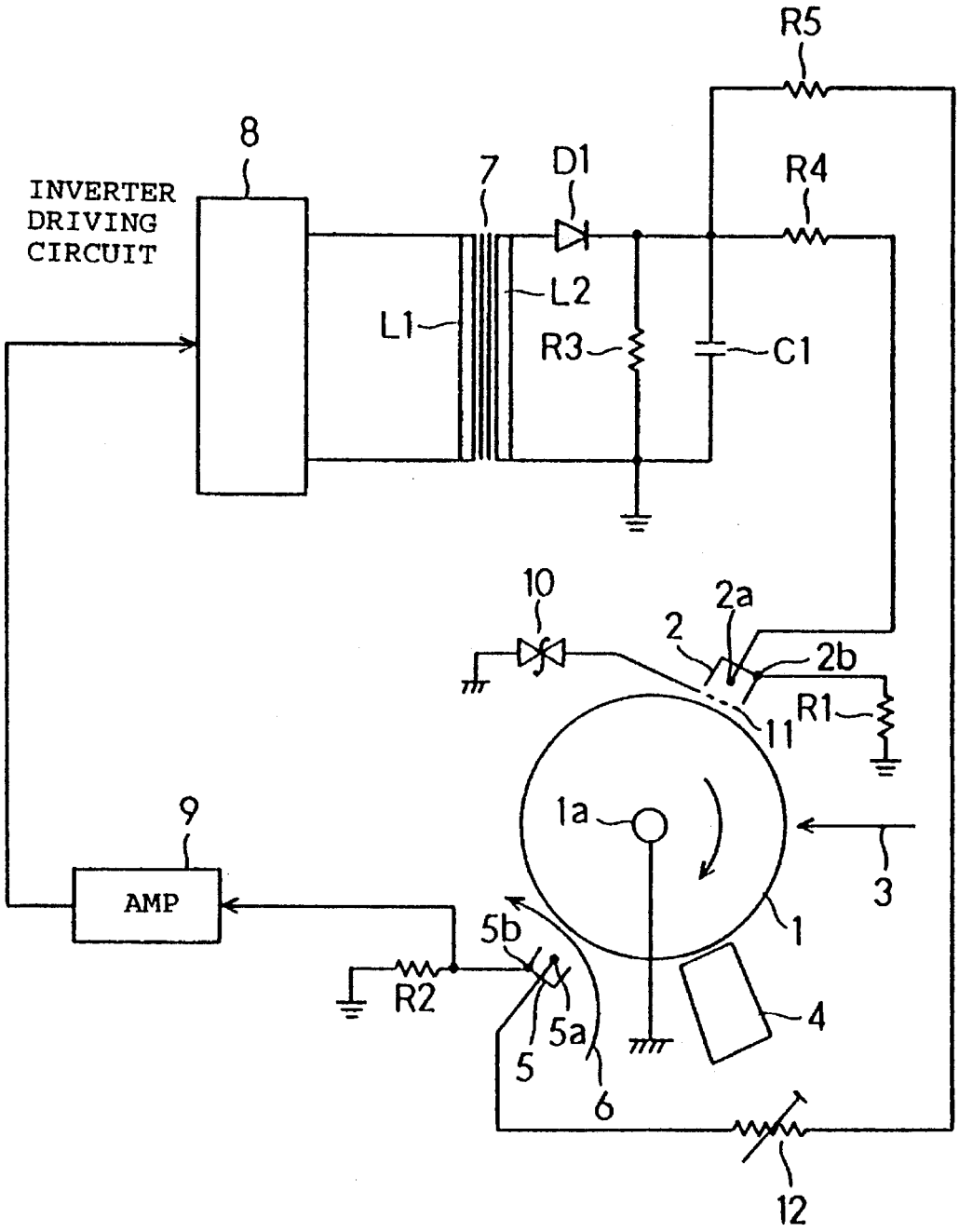
FIG. 2 is a circuit diagram of a relevant portion of an image forming apparatus embodying the present invention.

Hereinafter, the present invention will be described with reference to the drawings. Referring to FIG. 2, there is shown an embodiment employed in an electrophotographic copying machine. Reference numeral 1 represents a photoreceptor drum which rotates in the direction of the arrow. The photoreceptor drum 1 has a photosensitive layer on a metallic base which is connected to ground through a rotation axis 1*a*. Reference numeral 2 represents a main charger which supplies a positive charge to the surface of the photoreceptor drum 1. The main charger 2 includes a charging wire 2*a* and a shield 2*b* surrounding the charging wire 2*a*. Reference numeral 3 represents light reflected by an original. When a positive charge is discharged onto the photoreceptor drum 1, the resistance value of the portion where the reflected light strikes decreases to form a latent image on the photoreceptor drum 1.

Reference numeral 4 represents a developer unit which brings toner particles having a negative charge to the vicinity of the photoreceptor drum 1 so that the toner adheres to portions on the photoreceptor drum 1 where the positive charge remains, i.e. portions corresponding to dark portions of the original to form a toner image. Reference numeral 5 represents a transferring charger which causes the toner image on the photoreceptor drum 1 to adhere to a transfer sheet 6.

The transferring charger 5 is provided with a wire 5*a* and a shield 5*b*. The shields 2*b* and 5*b* of the chargers 2 and 5 are connected to ground by current detecting resistors R1 and R2, respectively. The load current of the transferring charger 5 detected by the resistor R2 is compared with a reference value by the error detecting amplifier 9 and inputted to the inverter driving circuit 8 to control the voltage applied to the primary side of the inverter transformer 7.

The chargers 2 and 5 are supplied with power from a secondary winding L2 of the transformer 7 by way of a circuit including a rectifier diode D1, a bleeder resistor R3 and a smoothing capacitor C1 and spark preventing resistors R4 and R5.

The load current flowing from the high voltage transformer 7 to the transferring chargers 2 and 5 is allotted from the charging wires 2*a* and 5*a* of the chargers 2 and 5 to the shields 2*b* and 5*b* of the chargers 2 and 5 and to the side of the photoreceptor drum 1 at a predetermined ratio. What essentially contributes to the charging to the photoreceptor drum 1 by the main charger 2 and to the transfer charging by the transferring charger 5 is the charging current flowing from the charging wires of the chargers 2 and 5 to the photoreceptor drum 1. Since the charging current is at a predetermined ratio to the current flowing from the charging wires to the shields of the chargers 2 and 5 as described above, in this embodiment, the charging current of the transferring charger 5 is maintained constant by correcting the variation in impedance of the transferring charger 5 due to a change of environment by sensing the current flowing through the shield of the transferring charger 5 by the resistor R2 to perform control as described above.

In this case, with respect to the main charger 2, the constant current control is not performed but the constant voltage control is performed. Specifically, the main charger 2 is provided with a grid 11, and a constant voltage device 10 is connected between the grid 11 and ground. The voltage of the grid 11 is controlled to be constant by the constant voltage device 10, and the potential of the surface of the photoreceptor drum 1 is always maintained at a desired value by maintaining constant the amount of uniform discharging to the surface of the photoreceptor drum 1.

The output current of the high voltage transformer 7 depends on the constant current control of the transferring charger 5. However, when the transferring charger 5 becomes dirty, the output current varies accordingly. While the output from the transferring charger 5, i.e. charging, is constant at this time, the charging by the main charger 2 varies. To prevent this, the allocation of the current is set so that $$\text{main charging current} > \text{transferring charging current} \quad (1)$$

in order that even though the output current of the transformer 7 varies for the above-mentioned reason, the constant voltage device 10 sufficiently absorbs the variation so that a constant surface potential is obtained on the main charger 2. To realize this, an impedance adjusting device 12 is provided on a power supplying route to the transferring charger 5. In this case, the impedance adjusting device 12 comprises a variable resistor.

Figure 3:
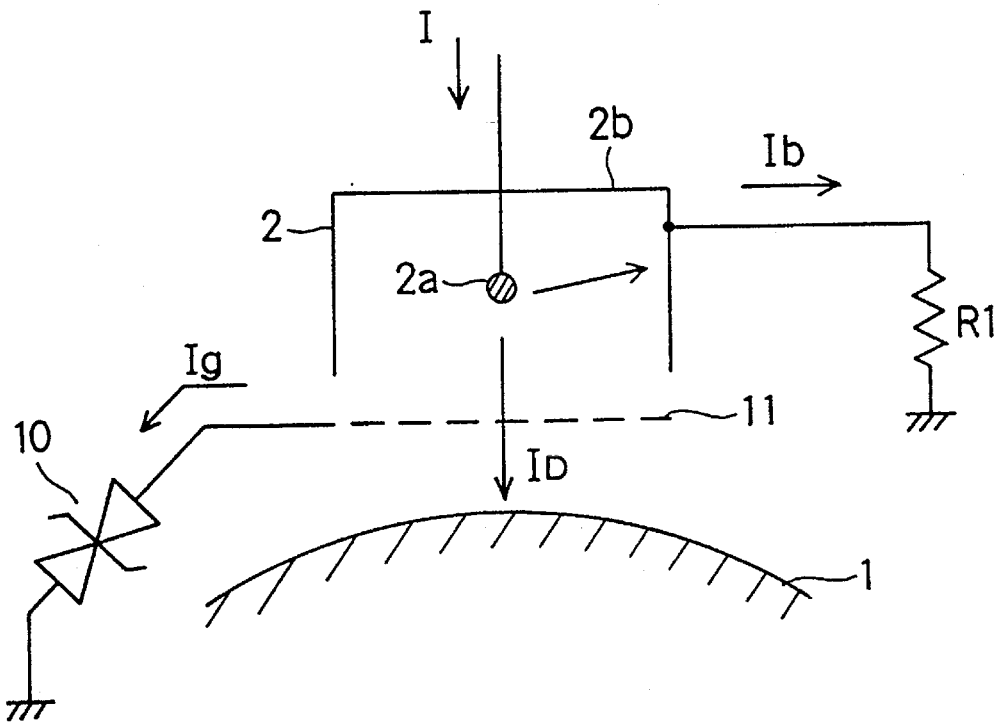
FIG. 3 is a view of assistance for explaining a part of FIG. 2.

Referring to FIG. 3, a current I supplied to the charging wire of the main charger 2 is $$I = Ib + (Ig + Id)$$

where Ib is a current flowing to the resistor R1, Ig is a current flowing from the grid 11 to the constant voltage device 10, and Id is a current flowing to the surface of the drum 1. The ratio between Ib and (Ig+Id) is fixed. When the current I is changed by the control by a transferring charger 5, the change amount ΔI of the current I is $$\Delta I = \Delta Ib + \Delta Ig.$$

Id does not change. Id is fixed when the voltage of the grid 11 is fixed. ΔIb and ΔIg are change amounts of Ib and Ig, respectively. The constant voltage device 10 requires a current of a value equal to or above a predetermined value to maintain its ON condition. Therefore, the above-mentioned condition (1) is preferably fulfilled in order to prevent Ig from not reaching the predetermined value because of a decrease in the current I of the main charger 2 by the control by the transferring charger 5.

As described above, according to the present invention, since the transferring charger is controlled so that the charging current is constant, even though the charger becomes dirty, mal-transfer and mal-separation of sheets do not occur. Moreover, the main charger is supplied with a high power, and by absorbing the variation in the current to perform the constant voltage control, an excellent charging is performed.

Obviously, many modifications and variations of the present invention are possible in light of the above teachings. It is therefore to be understood that within the scope of the appended claims, the invention may be practiced other than as specifically described.

What is claimed is:

1. An image forming apparatus, comprising:

a photoreceptor drum;

a main charger for charging a surface of the photoreceptor drum, the main charger including a wire, a shield, and a grid;

a transferring charger for generating an electric field toward the photoreceptor drum so that a toner image formed on the surface of the photoreceptor drum is transferred onto a sheet of paper, the transferring charger including a wire and a shield;

a high voltage transformer for supplying a high voltage to the main charger and to the transferring charger, the high voltage transformer being provided with one common secondary winding;

sensing means for sensing a shield current of the transferring charger;

primary side controlling means for controlling a primary side of the high voltage transformer based on an output of the sensing means so that the shield current is constant;

constant-voltage controlling means, connected to the grid of the main charger, for constant-voltage controlling the grid, the constant-voltage controlling means including a constant voltage device which is activated when a value of a current passing through the constant voltage device is equal to or above a predetermined value; and means for setting a current supplied from the high voltage transformer to the main charger to be greater than a current supplied from the high voltage transformer to the transferring charger.

2. An image forming apparatus according to claim 1, wherein the means for setting the current supplied from the high voltage transformer to the main charger to be greater than the current supplied from the high voltage transformer to the transferring charger is a resistor inserted in a current path to connect the secondary winding of the high voltage transformer to the shield of the transferring charger.

3. An image forming apparatus according to claim 2, wherein said resistor is a variable resistor.

* * * * *